US011662073B2

(12) United States Patent
Lee

(10) Patent No.: US 11,662,073 B2
(45) Date of Patent: May 30, 2023

(54) LAMP FOR VEHICLE WITH DIFFERENT LENSES

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/539,028

(22) Filed: Nov. 30, 2021

(65) Prior Publication Data

US 2022/0186898 A1 Jun. 16, 2022

(30) Foreign Application Priority Data

Dec. 11, 2020 (KR) ..... 10-2020-0173769
Dec. 11, 2020 (KR) ..... 10-2020-0173770

(51) Int. Cl.
*F21S 41/141* (2018.01)
*F21S 41/32* (2018.01)
(Continued)

(52) U.S. Cl.
CPC ..... *F21S 41/141* (2018.01); *F21S 41/27* (2018.01); *F21S 41/32* (2018.01); *F21S 41/43* (2018.01);
(Continued)

(58) Field of Classification Search
CPC ..... F21S 41/43; F21S 41/143; F21S 41/151; F21S 41/26; F21S 41/27; F21W 2102/135
See application file for complete search history.

(56) References Cited

U.S. PATENT DOCUMENTS

2013/0294102 A1* 11/2013 Iwasaki ..... F21S 41/143 362/520
2016/0290583 A1* 10/2016 Suwa ..... B62J 45/4151
(Continued)

FOREIGN PATENT DOCUMENTS

FR 3 010 772 3/2015
FR 3 079 598 10/2019
(Continued)

OTHER PUBLICATIONS

German Office Action dated Mar. 23, 2023 issued in DE 10 2021 131 425.9.
(Continued)

*Primary Examiner* — Oluseye Iwarere
*Assistant Examiner* — Michael Chiang
(74) *Attorney, Agent, or Firm* — DLA Piper LLP (US)

(57) ABSTRACT

A lamp for a vehicle includes a first lamp module including a first light source part, and a first lens structure that forms a first light distribution pattern with light irradiated from the first light source part, and a second lamp module including a second light source part, and a second lens structure that forms a second light distribution pattern having characteristics that are different from those of the first light distribution pattern with light irradiated from the second light source part. The first light distribution pattern and the second light distribution pattern overlap each other to form a low beam pattern. Shapes of input surfaces of the first lens structure and the second lens structure, to which the light is input, are different.

18 Claims, 10 Drawing Sheets

(51) Int. Cl.

| | |
|---|---|
| ***F21V 7/04*** | (2006.01) |
| ***F21S 41/43*** | (2018.01) |
| ***F21S 41/27*** | (2018.01) |
| *F21W 102/135* | (2018.01) |
| *F21Y 115/10* | (2016.01) |
| *F21W 107/10* | (2018.01) |
| *F21S 41/151* | (2018.01) |
| *F21S 41/143* | (2018.01) |

(52) U.S. Cl.
CPC ..... *F21V 7/04* (2013.01); *F21S 41/143* (2018.01); *F21S 41/151* (2018.01); *F21W 2102/135* (2018.01); *F21W 2107/10* (2018.01); *F21Y 2115/10* (2016.08)

(56) References Cited

U.S. PATENT DOCUMENTS

| | | | | |
|---|---|---|---|---|
| 2017/0030543 | A1* | 2/2017 | Gromfeld | F21S 41/322 |
| 2017/0343174 | A1* | 11/2017 | Owada | F21V 5/04 |
| 2018/0347776 | A1* | 12/2018 | Matsuda | F21S 41/24 |
| 2019/0203900 | A1* | 7/2019 | Nishimura | F21S 41/26 |
| 2021/0325017 | A1* | 10/2021 | Iwasaki | F21S 41/295 |
| 2022/0003375 | A1* | 1/2022 | Sugiyama | F21S 41/663 |

FOREIGN PATENT DOCUMENTS

| | | |
|---|---|---|
| JP | 2018-152356 | 9/2018 |
| JP | 2020-035702 | 3/2020 |
| WO | WO 2020/021825 | 1/2020 |
| WO | WO 2020/045674 | 3/2020 |

OTHER PUBLICATIONS

Chinese Office Action dated Mar. 21, 2023 issued in CN 202111513819.4.

English Language Abstract of WO 2020/045674 published Mar. 5, 2020.

English Language Abstract of WO 2020/021825 published Jan. 30, 2020.

* cited by examiner

LAMP FOR VEHICLE WITH DIFFERENT LENSES

CROSS-REFERENCE TO RELATED APPLICATION

This application claims the benefits of priorities to Korean Patent Application Nos. 10-2020-0173769 and 10-2020-0173770, filed in the Korean Intellectual Property Office on Dec. 11, 2020, the entire contents of which are incorporated herein by reference.

TECHNICAL FIELD

The present disclosure relates to a lamp for a vehicle, and more particularly, to a lamp for a vehicle that satisfies rules and performances for implementing a low beam pattern.

BACKGROUND

In general, a vehicle is equipped with various kinds of lamps having a lighting function for allowing a user to easily identify an object located around a vehicle during nighttime driving and a signal function for informing other vehicles or road users of a driving state of the vehicle.

For example, the vehicle includes headlamps and fog lamps (headlights or front lamps) that mainly perform a lighting function, and turn signal lamps, tail lamps, brake lamps, and side markers that mainly perform a signal function, installation references and standards of the lamps for vehicles are ruled by laws such that the lamps sufficiently show their functions.

Among the headlamps, a projection optical system for making the lamp itself as a unit is applied to a projection headlamp.

FIG. 10 illustrates a lamp 1 for a vehicle that implements a low beam by using a conventional protection optical system.

Referring to FIG. 10, the conventional lamp for a vehicle includes a light source 2, a reflector 3 having a reflection surface that reflects light irradiated from the light source, a shield 4 that shields a portion of the light reflected by the reflector, and an aspheric lens 5 that transmits and outputs the irradiated light. The light generated by the light source 2 is reflected by the reflector 3, and the reflected light passes through the aspheric lens 5.

However, because the conventional lamp for a vehicle that uses the projection optical system forms a light distributing pattern by applying an aspheric lens having a single focus, the rules for implementing a low beam or a high beam may not be satisfied due to a small horizontal diffusion angle.

Furthermore, in the conventional lamp for a vehicle using the projection optical system, light may be primarily lost in a process of reflecting the light from the light source 2 to the reflector 3. Furthermore, in recent years, because the light reflected by the reflector 3 has failed to be input to the aspheric lens 6 while a height of the lens is reduced due to slimness, the light may be secondarily lost (see a dotted line of FIG. 10).

The optical efficiency of the conventional lamp for a vehicle using the projection optical system decreases, and thus, optical performance decreases. Accordingly, it is necessary to improve a structure of a lamp for a vehicle to minimize loss of light while satisfying rules and performances.

SUMMARY

The present disclosure has been made to solve the above-mentioned problems occurring in the prior art while advantages achieved by the prior art are maintained intact.

An aspect of the present disclosure provides a lamp for a vehicle that realizes a beam pattern that is dispersed horizontally to satisfy all of rules and performances for implementing a low beam pattern.

Another aspect of the present disclosure provides a lamp for a vehicle that forms a cutoff line without providing a separate shield member by modifying a shape of a lens structure.

Another aspect of the present disclosure provides a lamp for a vehicle that may minimize loss of light that occurs in an optical system and may compensate for optical efficiency even when a height of tan output surface is decreased.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a lamp for a vehicle includes a first lamp module including a first light source part, and a first lens structure that forms a first light distribution pattern with light irradiated from the first light source part, and a second lamp module including a second light source part, and a second lens structure that forms a second light distribution pattern having characteristics that are different from those of the first light distribution pattern with light irradiated from the second light source part, the first light distribution pattern and the second light distribution pattern overlap each other to form a low beam pattern, and shapes of input surfaces of the first lens structure and the second lens structure, to which the light is input, are different.

The first lens structure may include a first body part disposed on a front side of the first light source part, a first input surface provided on a surface of the first body part, to which the light is input, such that the light irradiated from the first light source part is input to the first body part, and a first output surface provided on a surface of the first body part, from which the light is output, such that the light input to the first body part is output to a front side of the first body part, and a horizontal shape of the first input surface, which is viewed from an upper side, and a vertical shape of the first input surface, which is viewed from a lateral side, may be convexly curved in a direction that faces the first light source part.

The first body part may include a first recessed part having a shape that is curved toward a middle area of the first body part in an upward/downward direction.

The first recessed part may shield the light that is output from the first light source part and reaches the first recessed part.

The first recessed part may include a first shielding layer formed on a surface of the first recessed part, and that shields a portion of the light input to the first body part, and a first cutoff edge formed at an upper end of the first recessed part, and that forms a cutoff line of the lower beam pattern.

The first shielding layer may extend to be further inclined downwards in a direction that faces the first light source part as it goes from the first cutoff edge to a lower side, and may shield the light input to a lower end of the first cutoff edge.

The first recessed part may include a first surface provided adjacent to the first input surface, and a second surface extending from the first surface and provided adjacent to the first output surface, the first shielding layer may be formed on the first surface, and the first cutoff edge may be formed in an area, in which the first surface and the second surface meet each other.

An upward/downward size of the first input surface may be larger than or equal to an upward/downward size of the first output surface.

The second lens structure may include a second body part disposed on a front side of the second light source part, a second input surface provided on a surface of the second body part, to which the light is input, such that the light irradiated from the second light source part is input to the second body part, and a second output surface provided on a surface of the second body part, from which the light is output, such that the light input to the second body part is output to a front side of the second body part, and a horizontal shape of the second input surface, which is viewed from an upper side, may be concavely curved in a direction that is opposite to a direction that faces the second light source part, or is flat, and a vertical shape of the second input surface, which is viewed from a lateral side, may be convexly curved in the direction that faces the second light source part.

The second body part may include a second recessed part having a shape that is curved toward a middle area of the second body part in an upward/downward direction.

The second recessed part may shield the light that is output from the second light source part and reaches the second recessed part.

The second recessed part may include a second shielding layer formed on a surface of the second recessed part, and that shields a portion of the light input to the second body part, and a second cutoff edge formed at an upper end of the second recessed part, and that forms a cutoff line of the lower beam pattern.

The second shielding layer may extend to be further inclined downwards in a direction that faces the second light source part as it goes from the second cutoff edge to a lower side, and may shield the light input to a lower end of the second cutoff edge.

The second recessed part may include a third surface provided adjacent to the second input surface, and a fourth surface extending from the third surface and provided adjacent to the second output surface, the second shielding layer may be formed on the third surface, and the second cutoff edge may be formed in an area, in which the third surface and the fourth surface meet each other.

An upward/downward size of the second input surface may be larger than or equal to an upward/downward size of the second output surface.

A plurality of first lamp modules and a plurality of second modules may be provided.

The plurality of first lamp modules and the plurality of second lamp modules may be alternately disposed along one direction.

The first light source part may include a first light source that generates light, and a first collimator provided on a front side of the first light source, and that converts the light radiated from the first light source to parallel light that is parallel to an optical axis of the first lens structure to input the parallel light to the first lens structure.

The second light source part may include a second light source that generates light, and a second collimator provided on a front side of the second light source, and that converts the light radiated from the second light source to parallel light that is parallel to an optical axis of the second lens structure to input the parallel light to the second lens structure.

According to another aspect of the present disclosure, a lamp for a vehicle may include a light source part that irradiates light, and a lens structure disposed on a front side of the light source part, and that transmits the light irradiated from the light source part to form a specific beam pattern, the lens structure includes body part, an input surface formed on a surface of the body part, to which the light is input, and that inputs the light irradiated from the light source part to the body part, and an output surface formed on a surface of the body part, from which the light is output, and that outputs the light input to the body part to a front side, and the body part may include a recessed part having a shape that is recessed toward a middle area of the body part in an upward/downward direction, and the recessed part may shield the light that is output from the light source part and reaches the recessed part.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, embodiments of the present disclosure will be described in detail with reference to the accompanying drawings.

First, the embodiments described herein are embodiments that are suitable for understanding the technical features of a lamp for a vehicle according to the present disclosure. However, the present disclosure is not limited to the embodiment described below or the technical features of the present disclosure are not limited by the described embodiments, and the present disclosure may be variously modified without departing from the technical scope of the present disclosure.

Figure 1:
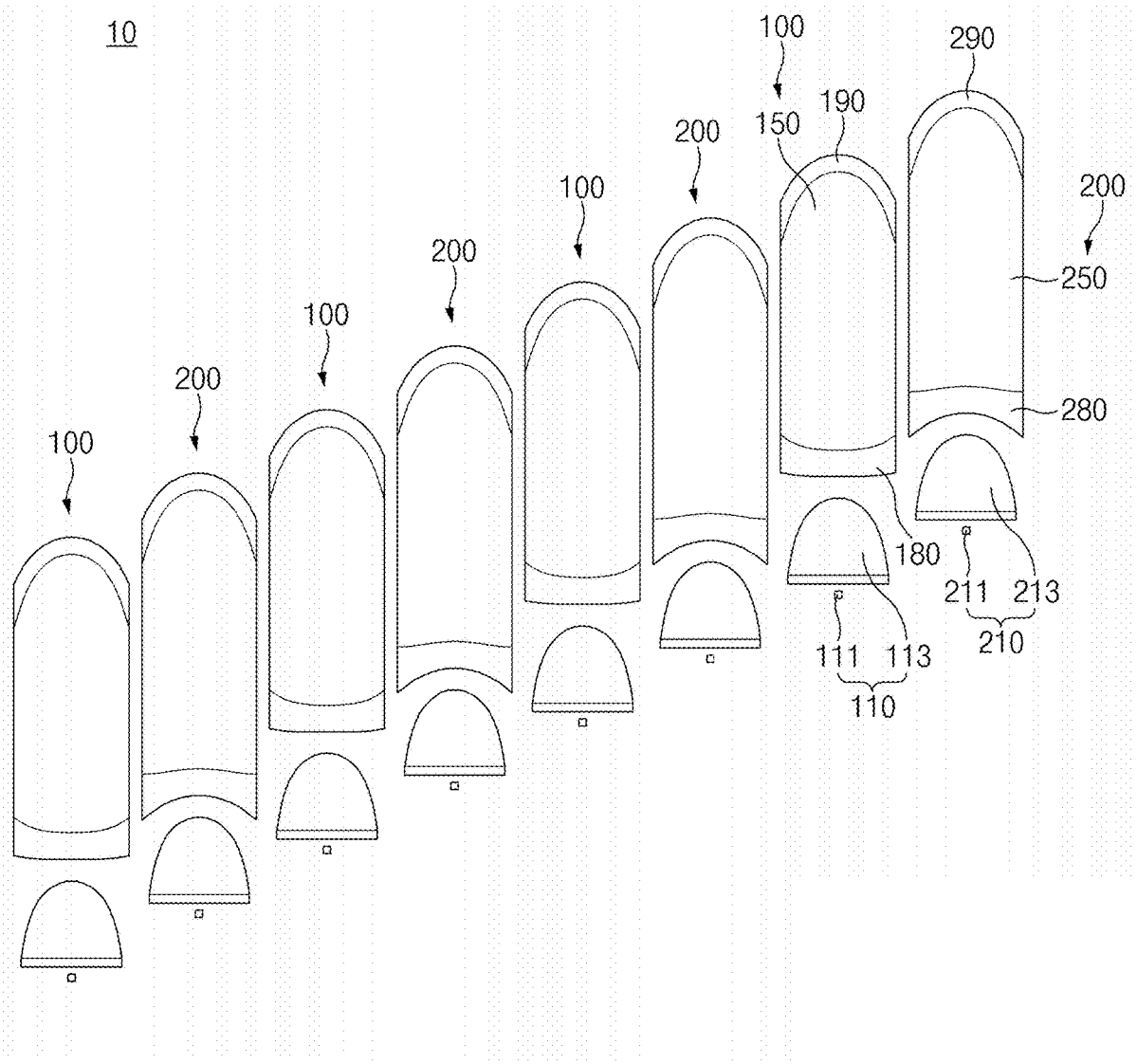
FIG. 1 is a top view illustrating a lamp for a vehicle according to an embodiment of the present disclosure.
Figure 2:
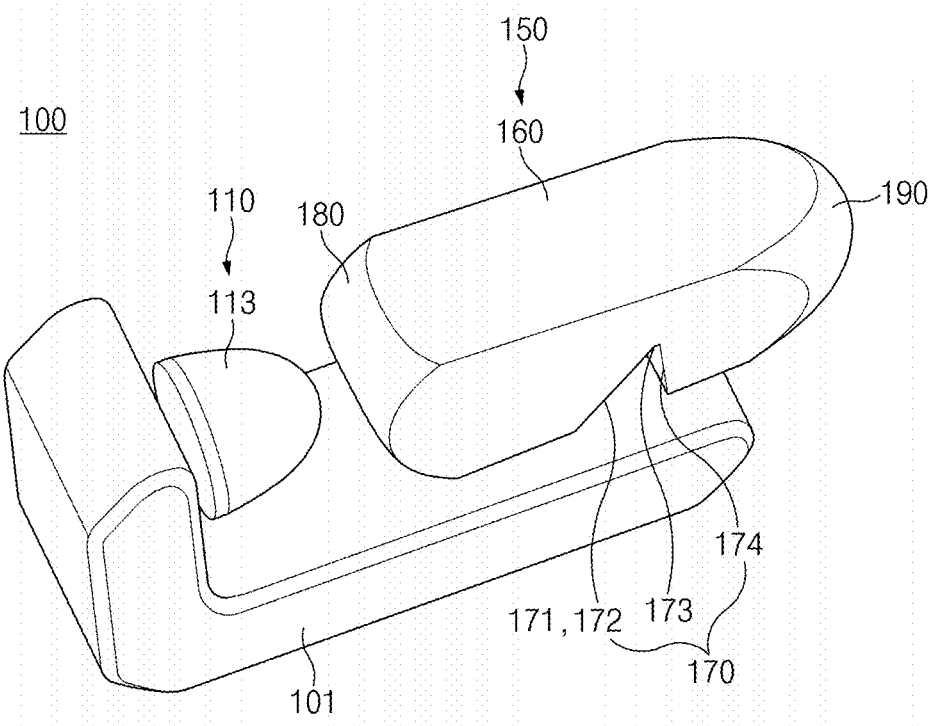
FIG. 2 is a perspective view of a first lamp module according to an embodiment of the present disclosure.
Figure 3:
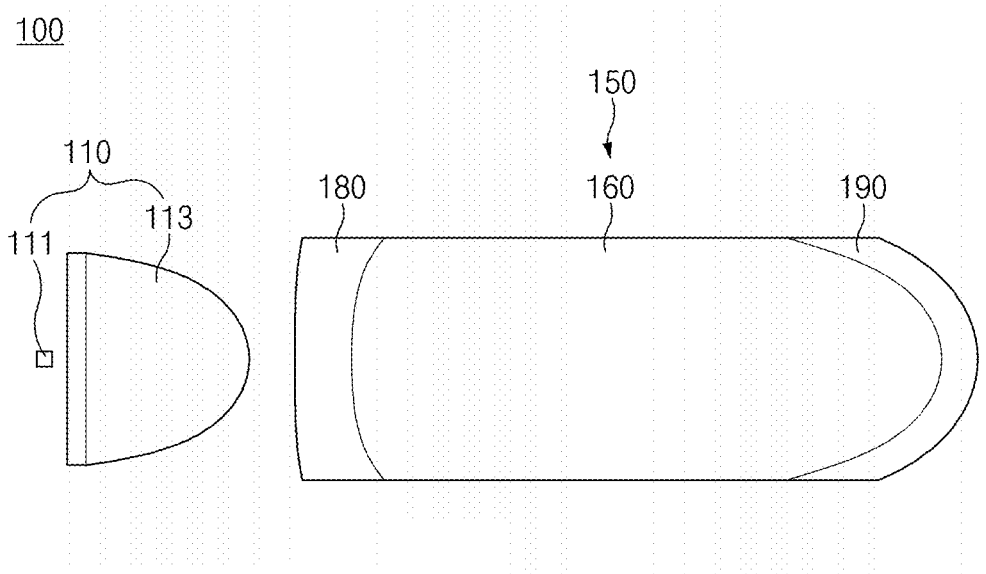
FIG. 3 is a top view of the first lamp module according to an embodiment of the present disclosure.
Figure 4:
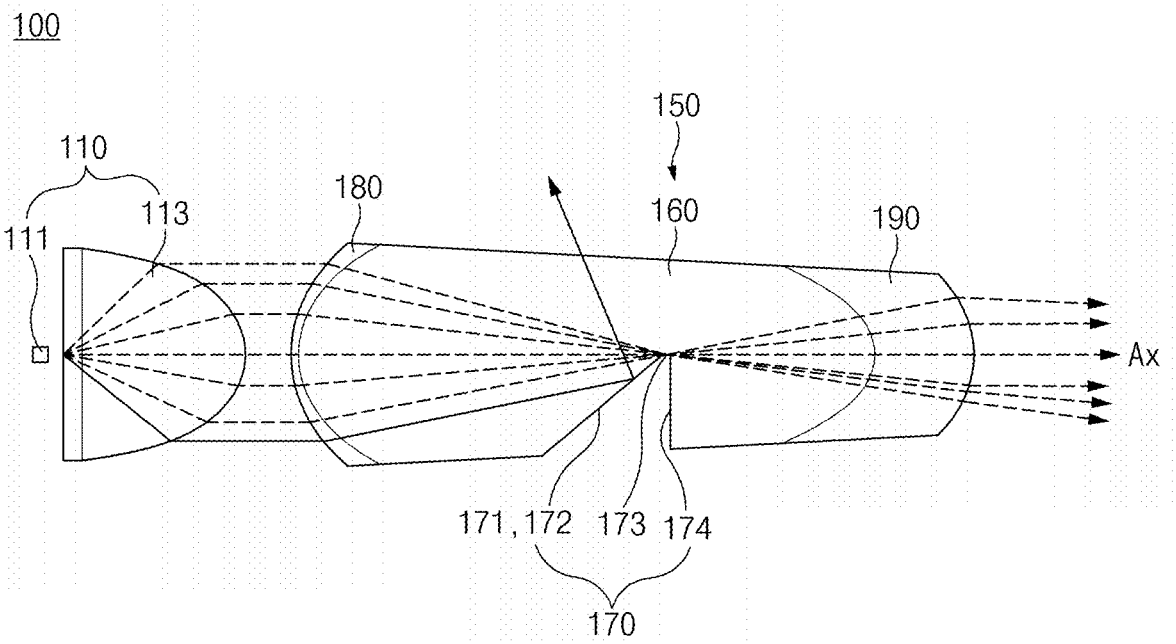
FIG. 4 is a side view of the first lamp module according to an embodiment of the present disclosure.

FIG. 1 is a top view illustrating a lamp for a vehicle according to an embodiment of the present disclosure. FIG. 2 is a perspective view of a first lamp module according to an embodiment of the present disclosure. FIG. 3 is a top view of the first lamp module according to an embodiment of the present disclosure. FIG. 4 is a side view of the first lamp module according to an embodiment of the present disclosure.

Figure 5:
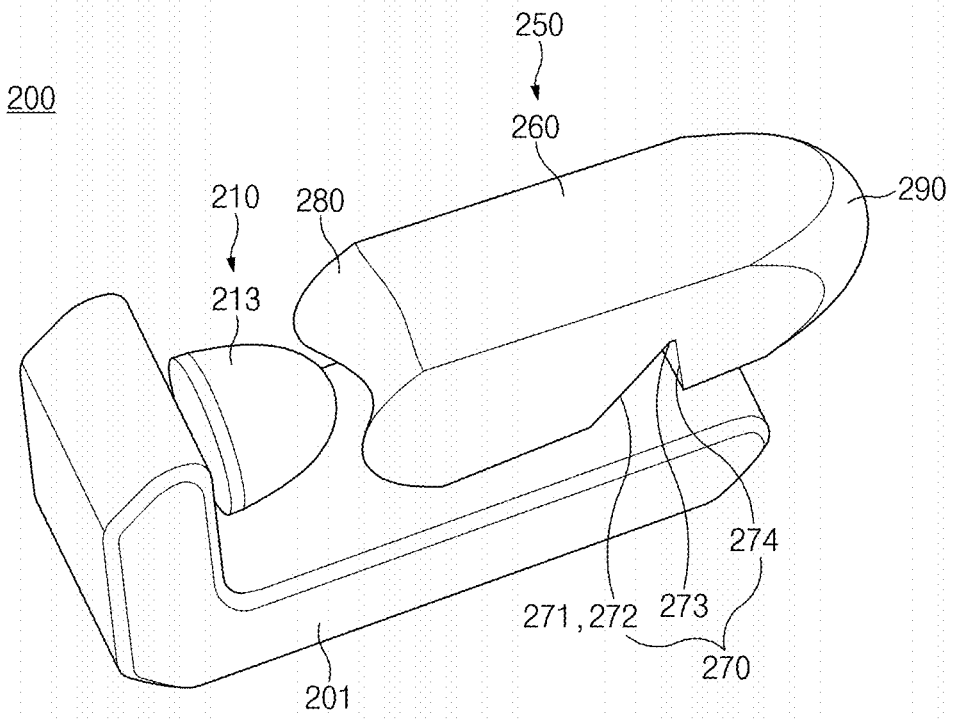
FIG. 5 is a perspective view of a second lamp module according to an embodiment of the present disclosure.
Figure 6:
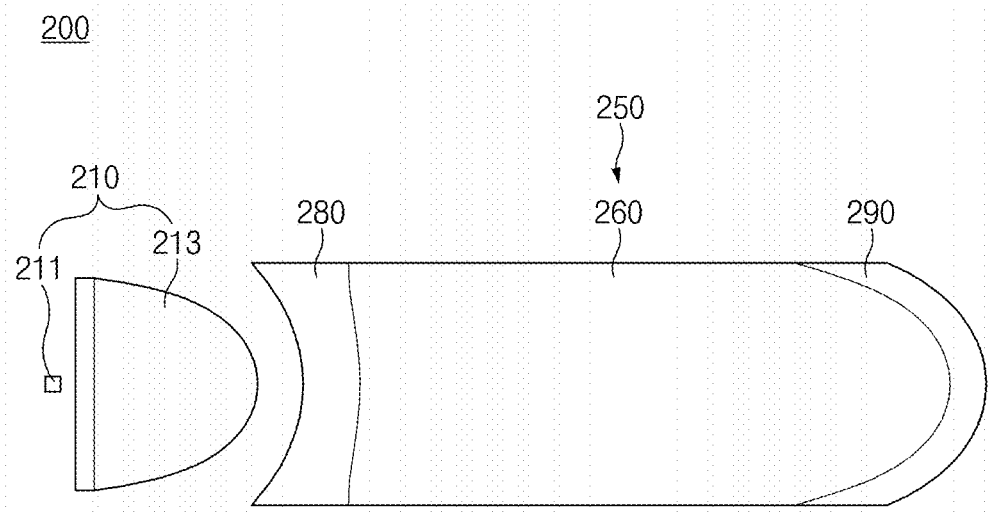
FIG. 6 is a top view of the second lamp module according to an embodiment of the present disclosure.
Figure 7:
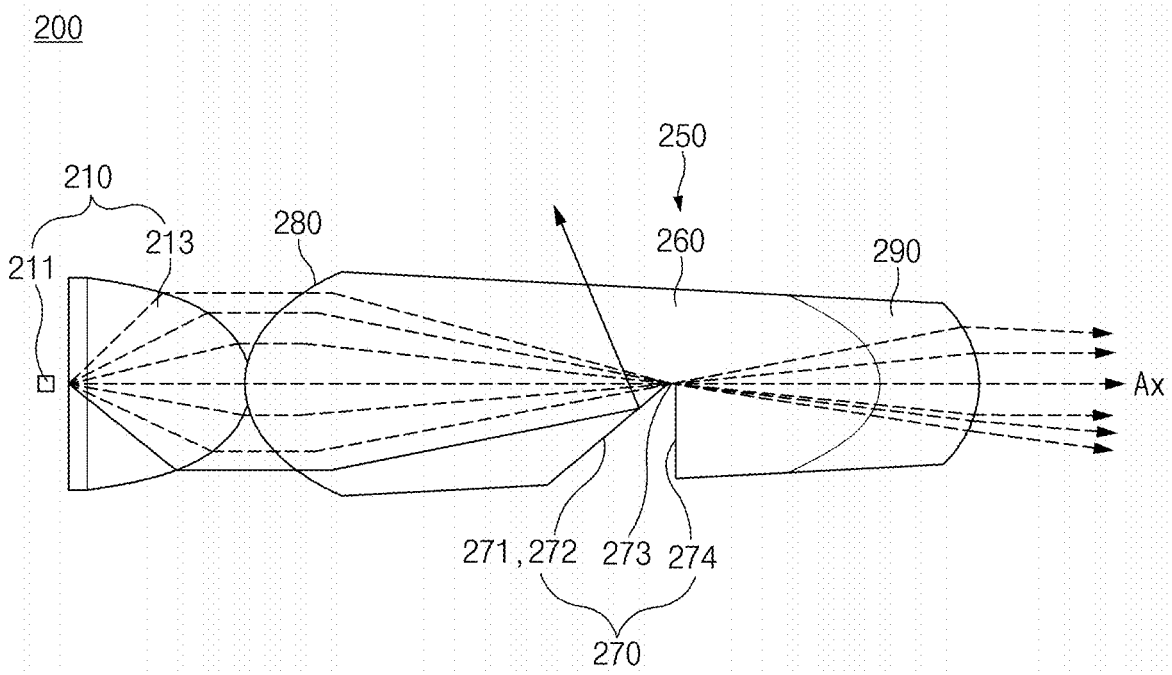
FIG. 7 is a side view of the second lamp module according to an embodiment of the present disclosure.
Figure 8:
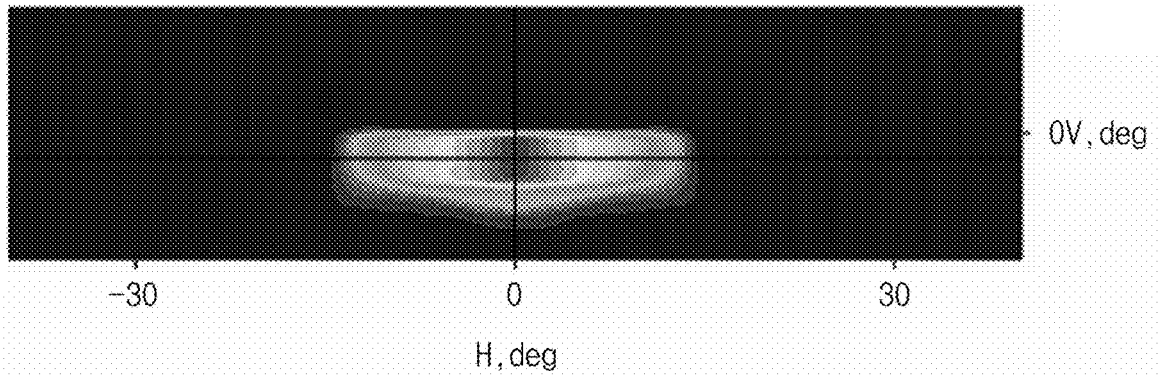
FIG. 8 is a view illustrating a light distribution pattern of the first lamp module according to an embodiment of the present disclosure.
Figure 9:
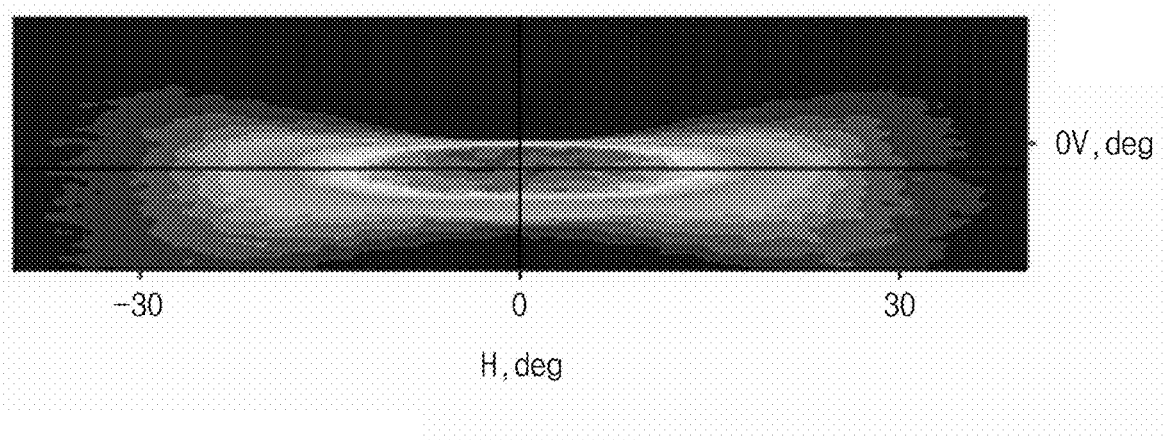
FIG. 9 is a view illustrating a light distribution pattern of the second lamp module according to an embodiment of the present disclosure.
Figure 10:
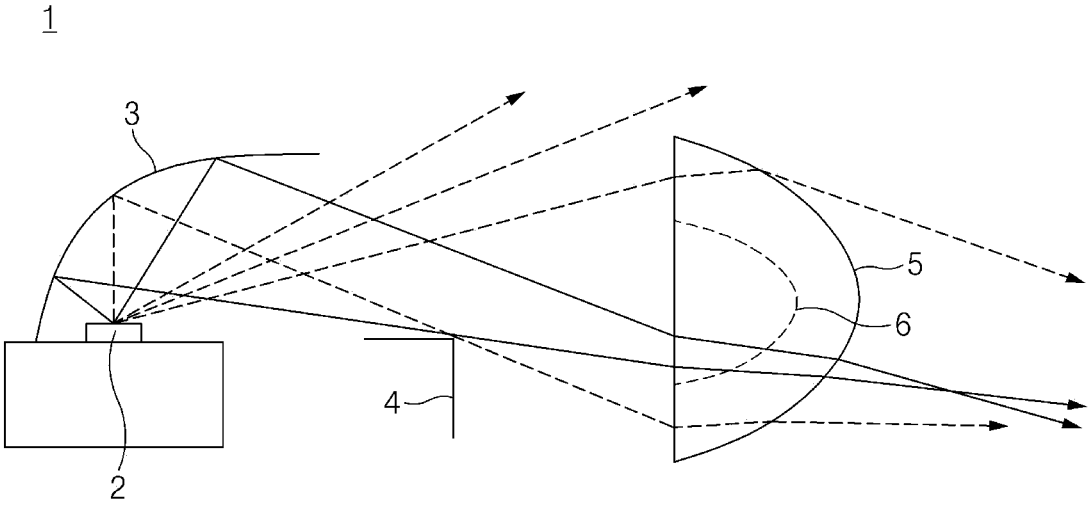
FIG.10 PRIOR ART
FIG. 10 is a view schematically illustrating a configuration of a lamp for a vehicle according to the related art.

FIG. 5 is a perspective view of a second lamp module according to an embodiment of the present disclosure. FIG. 6 is a top view of the second lamp module according to an embodiment of the present disclosure. FIG. 7 is a side view of the second lamp module according to an embodiment of the present disclosure. FIG. 8 is a view illustrating a light distribution pattern of the first lamp module according to an embodiment of the present disclosure. FIG. 9 is a view illustrating a light distribution pattern of the second lamp module according to an embodiment of the present disclosure.

Referring to FIGS. 1 to 7, a lamp 10 for a vehicle according to an embodiment of the present disclosure includes a first lamp module 100 and a second lamp module 200.

The first lamp module 100 includes a first light source part 110 and a first lens structure 150.

The first light source part 110 is configured to generate and irradiate light. Here, various elements or devices that may emit light may be used for the first light source part 110. The first light source part 110 may include a first light source 111 that generates light, and the first light source 111, for example, may be a light emitting diode (hereinafter, referred to as an LED). However, the first light source 111 is not limited to an LED.

For example, the first light source part 110 may be configured to irradiate parallel light to a front side that faces the first lens structure 150. In detail, the first light source part 110 may further include a first collimator 113. The first collimator 113 may be provided in a direction that faces the first lens structure 150 of the first light source 111, and may be configured to convert the light radiated from the first light source 111 to parallel light that is parallel to an optical axis AX of the first lens structure 150 and input the parallel light to the first lens structure 150.

The first lens structure 150 forms a first light distribution pattern with the light irradiated from the first light source part 110.

In detail, the first lens structure 150 may be disposed on a front side of the first light source part 110, and may be configured to transmit the light irradiated from the first light source part 110 to form the first light distribution pattern. For example, the first lamp module 100 may include a first base 101, in which the first light source part 110 and the first lens structure 150 are installed. Hereinafter, a direction, in which the light is irradiated, and which faces the first lens structure 150 from the first light source 111, will be referred to as a front side, and an opposite direction to the front side will be a rear side, for convenience of description.

The first lens structure 150 may include a first body part 160, a first input surface 180, and a first output surface 190.

The first body part 160 forms a body of the first lens structure 150, and may be formed of a material that transmits the input light. The first body part 160 may be disposed on a front side of the first light source part 110.

The first input surface 180 may be provided on a surface of the first body part 160 such that the light irradiated from the first light source part 110 is input to the first body part 160. Furthermore, the first output surface 190 may be provided on a surface of the first body part 160, from which the light is output, such that the light input to the first body part 160 is output to a front side of the first body part 160.

In detail, the first body part 160, the first input surface 180, and the first output surface 190 may be integrally formed, the first input surface 180 may be formed on a surface of the first body part 160, which faces the rear side, and the first output surface 190 may be formed on a surface of the first body part 160, which faces the front side. The first input surface 180 may be configured to condense the light irradiated from the first light source part 110 to an interior of the first body part 160.

The first output surface 190 may be configured to output the light that passes through the first body part 160 of the first lens structure 150 to the front side. For example, the first output surface 190 may be formed to be curved toward the front side, and may be provided in a form of a aspheric surface. However, the first output surface 190 is not limited to the form of an aspheric lens, but various forms of lenses may be applied. As an example, the first output surface 190 may be provided in a form of a Fresnel lens that may decrease thickness for a degree of freedom of design.

Here, an optical axis AX of the first output surface 190 and an optical axis of the first input surface 180 may be the same. In an embodiment of the present disclosure, an optical axis AX of the first lens structure 150 means the optical axis AX of the first output surface 190 or the first input surface 180.

The light radiated from the first light source 111 may be converted to the parallel light through the first collimator 113 to be input to the first input surface 180, and the input light may be condensed in the interior of the first body part 160 by the first input surface 180. In detail, the first input surface 180 may condense the light input from the first light source part 110 to a vicinity of a focus of the first output surface 190. Here, the first light source 111, the first collimator 113, and the first lens structure 150 may be arranged along a direction of the optical axis AX of the lens structure 150.

The second lamp module 200 includes a second light source part 210 and a second lens structure 250.

The second light source part 210 is configured to generate and irradiate light. Here, various elements or devices that may emit light may be used for the second light source part 210. The second light source part 210 may include a second light source 211 that generates light, and the second light source 211, for example, may be an LED but the second light source 211 is not limited to an LED.

For example, the second light source part 210 may be configured to irradiate parallel light to a front side that faces the second lens structure 250. In detail, the second light source part 210 may further include a second collimator 213. The second collimator 213 may be provided in a direction that faces the second lens structure 250 of the second light source 211, and may be configured to convert the light radiated from the second light source 211 to parallel light that is parallel to an optical axis AX of the second lens structure 250 and input the parallel light to the second lens structure 250.

The second lens structure 250 forms a second light distribution pattern having characteristics that are different from those of the first light distribution pattern with the light irradiated from the first light source part 210.

In detail, the second lens structure 250 may be disposed on a front side of the second light source part 210, and may be configured to transmit the light irradiated from the second light source part 210 to form the second light distribution pattern. For example, the second lamp module 200 may include a second base 201, in which the second light source part 210 and the second lens structure 250 are installed.

Hereinafter, a direction, in which the light is irradiated, and which faces the second lens structure 250 from the second light source 211, will be referred to as a front side, and an opposite direction to the front side will be a rear side, for convenience of description.

The second lens structure 250 may include a second body part 260, a second input surface 280, and a second output surface 290.

The second body part 260 forms a body of the second lens structure 250, and may be formed of a material that transmits the input light. The second body part 260 may be disposed on a front side of the second light source part 210.

The second input surface 280 may be provided on a surface of the second body part 260 such that the light irradiated from the second light source part 210 is input to the second body part 260. Furthermore, the second output surface 290 may be provided on a surface of the second body part 260, from which the light is output, such that the light input to the second body part 260 is output to a front side of the second body part 260.

In detail, the second body part 260, the second input surface 280, and the second output surface 290 may be integrally formed, the second input surface 280 may be formed on a surface of the second body part 260, which faces the rear side, and the second output surface 290 may be formed on a surface of the second body part 260, which faces the front side. The second input surface 280 may be configured to condense the light irradiated from the second light source part 210 to an interior of the second body part 260. Here, a shape and a lens form of the second output surface 290 may be the same as those of the first output surface 190.

The first light distribution pattern and the second light distribution pattern may have different characteristics. Furthermore, the first light distribution pattern and the second light distribution pattern may overlap each other to form a low beam pattern.

Here, an aspect that the first light distribution pattern and the second light distribution pattern have different characteristic means that the pattern images of the light transmitted by the first lens structure 150 and the second lens structure 250 are different. For example, this may be implemented by a difference between the shapes of the first lens structure 150 and the second lens structure 250.

For example, the first light distribution pattern formed by the first light sources 150 may be a light distribution pattern (a hot zone) for securing a field of view of a central area of a front side (see FIG. 8). Furthermore, the second light distribution pattern formed by the second light sources 250 may be a light distribution pattern (a wide zone) for securing a field of view of a peripheral area of a front side and a visibility during rotation (see FIG. 9). Furthermore, the first light distribution pattern and the second light distribution pattern may form the low beam pattern that is a pattern that projected to the front side to be integrated.

Shapes of the input surfaces of the first lens structure 150 and the second lens structure 250, to which the light is input, may be different. That is, the first input surface 180 and the second input surface 280 may have different shapes.

A horizontal shape of the first input surface 180, which is viewed from an upper side, and a vertical shape of the first input surface, which is viewed from a lateral side, may have shapes that are convexly curved in a direction that toward the first light source part 110. That is, both of the horizontal shape and the vertical shape of the first input surface 180 may be convex toward the first light source part 110.

Because the horizontal shape of the first input surface 180 is convex, the horizontal light input to the first input surface 180 may be condensed to the interior of the first body part 160. Because the vertical shape of the first input surface 180 is convex, the vertical light input to the first input surface 180 may be condensed to the interior of the first body part 160.

In this way, because the first input surface 180 is configured to condense the horizontal light and the vertical light irradiated from the first light source part 110 to the first body part 160 maximally, loss of the light may be minimized, and thus optical efficiency may be increased. The first lamp module 100 may effectively form the first light distribution pattern (the hot zone) that is advantageous in far-distance irradiation for securing a field of view of a central area.

A horizontal shape of the second input surface 280, which is viewed from an upper side, may be formed to have a shape that is concavely curved in a direction that is opposite to a direction that faces the second light source part 210, or to be flat, and a vertical shape of the second input surface, which is viewed from a lateral side, may have a shape that is convexly curved in the direction that faces the second light source part 210. The second input surface 280 may be formed such that a magnification in a horizontal direction and a magnification in a vertical direction may be different in an anamorphic lens.

Because the horizontal shape of the second input surface 280 may have a concave or flat shape, the horizontal light input to the second input surface 280 may diverge. Meanwhile, because the vertical shape of the second input surface 280 is convex, the vertical light input to the second input surface 280 may be condensed to the interior of the first body part 160.

In this way, because the second input surface 280 is configured to condense the vertical light irradiated from the second light source part 210 to the interior of the first body part 160 and disperse the horizontal light, the light output through the second lens structure 250 may form a light pattern that spreads out horizontally widely. Accordingly, the second lamp module 200 may effectively form the second light distribution pattern (the wide zone) that is advantageous for securing visibility for a peripheral area of a front side and visibility during turning.

As an example, both of the first input surface 180 and the second input surface 280 have the same shape (for example, a convex shape), it is advantageous for light condensing and may minimize loss of light, but a horizontal diffusion angle of the light output through the lamp may be formed narrowly. Conditions of the beam pattern are ruled such that the lamp 10 for a vehicle may sufficiently show the functions, and when both of the first input surface 180 and the second input surface 280 have the same shape, this may fail to satisfy the rules that define diffusion angle conditions of a low beam pattern defined by the rules.

To solve the problem, in the embodiment of the present disclosure, the light input to the second input surface 280 is diffused horizontally by forming the horizontal shape of the second input surface 280 in a concave or flat shape, whereby all the rules and performance for implementing the low beam pattern may be satisfied.

Meanwhile, the first body part 160 may include a first recessed part 170 having a shape that is curved toward a middle area of the first body part 160 in an upward/downward direction. The first recessed part 170 may be configured to shield the light that is output from the first light source part 110 and reaches the first recessed part 170.

In detail, the first recessed part 170 may have a shape that is recessed toward the middle area from the lower surface of the first body part 160. Then, the first recessed part 170 may be disposed on a path, along which the light input to the first body part 160 travels. Furthermore, the first recessed part 170 may be configured to shield a portion of the light.

In detail, according to the lamp 10 for a vehicle according to the embodiment of the present disclosure, a focus of the first output surface 190 may be located in the first body part 160 of the first lens structure 150, and the first recessed part 170 may be formed at a location corresponding to the focus of the first output surface 190. Accordingly, the first recessed part 170 may shield a portion of the light at the location corresponding to the focus of the first output surface 190.

According to the present disclosure, because a portion of the light is shielded by the first recessed part 170, the light output from the first output surface 190 may form a cutoff line of the lower beam pattern. That is, according to the present disclosure, because the first recessed part 170 is formed by modifying the shape of the first body part 160 to form a cutoff line in a structure for minimizing loss of light, the cutoff line may be formed without providing a separate shield member.

The first body part 160 may include an upper surface that connects the first input surface 180 and the first output surface 190, a lower surface disposed to face the upper surface, a side surface disposed between the upper surface and the lower surface. Here, total reflection of the light output from the first light source 111 may not occur on the upper surface, the lower surface, and the side surface of the first body part 160.

The first recessed part 170 may be recessed toward a central portion of the first body part 160 in a partial area of a lower surface thereof. In more detail, the first recessed part 170 may include a first surface 171 provided adjacent to the first input surface 180, and a second surface 174 that is bent from the first surface 171 at a specific angle and is adjacent to the first output surface 190.

Here, an inclination of the second surface 174 may be steeper than an inclination of the first surface 171. As an example, the first surface 171 may be inclined upwards on the lower surface, and the second surface 174 may extend from an upper end of the first surface 171 in a vertical direction toward a lower side. However, the shapes of the first surface 171 and the second surface 174 are not limited to the above-described ones.

The first recessed part 170 may include a first shielding layer 172 and a first cutoff edge 173.

The first shielding layer 172 may be formed on a surface of the first recessed part 170, and may be configured to shield a portion of the light input to the first body part 160. Furthermore, the first cutoff edge 173 may be formed at an upper end of the first recessed part 170, and may be configured to form a cutoff line of the lower beam pattern.

In detail, the first shielding layer 172 may be formed on the first surface 171. Furthermore, the first shielding layer 172 may extend to be inclined downwards in a direction that faces the first light source part 110 as it goes from the first cutoff edge 173 to the lower side, and may be configured to shield the light input to a lower end of the first cutoff edge 173.

For example, the first shielding layer 172 may be formed on the first surface 171 through deposition, and the first shielding layer 172 may be formed of various materials that may shield light. As an example, the first shielding layer 172 may be formed through deposition of aluminum such that the light is reflected on the first surface 171. The second surface 174 is a part for connecting the upper end of the first surface 171 and the lower surface that is adjacent to the first output surface 190.

However, the material and forming method of the first shielding layer 172 are not limited to the above-described ones, and various materials and schemes may be applied as long as the first shielding layer 172 may shield light.

The first cutoff edge 173 is formed at an upper end of the first shielding layer 172, and is configured to form the cutoff line of the lower beam pattern.

In detail, the first cutoff edge 173 may be provided at a location corresponding to the focus of the first output surface 190. As an example, the first cutoff edge 173 may on the focus of the first output surface 190. In detail, the first cutoff edge 173 may be formed in an area, in which the first surface 171 and the second surface 174 meet each other. Here, the shape of the first cutoff edge 173 is not limited, and may be variously determined according to a design specification for forming the low beam pattern.

In this way, the lamp 10 for a vehicle according to the embodiment of the present disclosure may form the cutoff line without providing a separate shield member by modifying the shape of the first body part 160 provided in the first lens structure 150 to form the first recessed part 170.

Meanwhile, an upward/downward size of the first input surface 180 may be larger than or equal to an upward/downward size of the first output surface 190.

In detail, the first output surface 190 is a portion exposed to the outside and thus the size of the first output surface 190 is limited by a design or the rules of the lamp, but the first input surface 180 is disposed inside the vehicle body and is not exposed to the outside, and thus the relative size of the first input surface 180 is not limited. Accordingly, the size of the first input surface 180 may be the same as or equal to that of the first output surface 190. Accordingly, the light irradiated from the first light source part 110 may be maximally condensed to minimize loss of light.

To implement the shape, for example, referring to FIG. 4, the upper surface of the first body part 160 may be inclined downward to the front side. Furthermore, the lower surface may be formed horizontally or inclined downwards to the front side, and may be inclined less or may be inclined upwards to the front side.

Meanwhile, the first body part 260 may include a second recessed part 270 having a shape that is curved toward a middle area of the second body part 260 in an upward/downward direction. The second recessed part 270 may be configured to shield the light that is output from the second light source part 210 and reaches the second recessed part 270. The second recessed part 270 may have the same shape as that of the first recessed part 170, or may be modified within a specific range according to a design specification.

In detail, the second recessed part 270 may have a shape that is recessed toward the middle area from the lower surface of the second body part 260. Then, the second recessed part 270 may be disposed on a path, along which the light input to the second body part 260 travels. For example, the second recessed part 270 may be formed in a middle area of the second body part 260, and may shield a portion of the light at a location corresponding to the focus of the second output surface 290.

In detail, according to the lamp 10 for a vehicle according to the embodiment of the present disclosure, a focus of the second output surface 290 may be located in the second body part 260 of the second lens structure 250, and the second recessed part 270 may be formed at a location corresponding to the focus of the second output surface 290.

Accordingly, the second recessed part 270 may shield a portion of the light at the location corresponding to the focus of the second output surface 290.

According to the present disclosure, because a portion of the light is shielded by the second recessed part 270, the light output from the second output surface 290 may form a cutoff line of the lower beam pattern. Accordingly, the present disclosure may form the cutoff line without providing a separate shield member.

The second body part 260 may include an upper surface that connects the second input surface 280 and the second output surface 290, a lower surface disposed to face the upper surface, a side surface disposed between the upper surface and the lower surface. Here, total reflection of the light output from the first light source 211 may not occur on the upper surface, the lower surface, and the side surface of the second body part 260.

The second recessed part 270 may be recessed toward a central portion of the second body part 260 in a partial area of a lower surface thereof. In more detail, the second recessed part 270 may include a third surface 271 provided adjacent to the second input surface 280, and a fourth surface 274 that is bent from the third surface 271 at a specific angle and is adjacent to the second output surface 290.

Here, an inclination of the fourth surface 274 may be steeper than an inclination of the third surface 271. As an example, the third surface 271 may be inclined upwards on the lower surface, and the fourth surface 274 may extend from an upper end of the third surface 271 in a vertical direction toward a lower side. However, the shapes of the third surface 271 and the fourth surface 274 are not limited to the above-described ones.

The second recessed part 270 may include a second shielding layer 272 and a second cutoff edge 273.

The second shielding layer 272 may be formed on a surface of the second recessed part 270, and may be configured to shield a portion of the light input to the second body part 260. Furthermore, the second cutoff edge 273 may be formed at an upper end of the second recessed part 270, and may be configured to form a cutoff line of the lower beam pattern.

In detail, the second shielding layer 272 may be formed on the third surface 271. Furthermore, the second shielding layer 272 may extend to be inclined downwards in a direction that faces the second light source part 210 as it goes from the second cutoff edge 273 to the lower side, and may be configured to shield the light input to a lower end of the second cutoff edge 273.

For example, the second shielding layer 272 may be formed on the third surface 271 through deposition, and the second shielding layer 272 may be formed of various materials that may shield light. As an example, the second shielding layer 272 may be formed through deposition of aluminum such that the light is reflected on the third surface 271.

The second cutoff edge 273 is formed at an upper end of the second shielding layer 272, and is configured to form the cutoff line of the lower beam pattern.

In detail, the second cutoff edge 273 may be provided at a location corresponding to the focus of the second output surface 290. As an example, the second cutoff edge 273 may on the focus of the second output surface 290. In detail, the second cutoff edge 273 may be formed in an area, in which the third surface 271 and the fourth surface 274 meet each other. Here, the shape of the second cutoff edge 273 is not limited, and may be variously determined according to a design specification for forming the low beam pattern.

In this way, to the embodiment of the present disclosure may form the cutoff line without providing a separate shield member by modifying the shape of the second body part 260 provided in the second lens structure 250 to form the second recessed part 270.

Meanwhile, an upward/downward size of the second input surface 280 may be larger than or equal to an upward/downward size of the second output surface 290. Accordingly, the light irradiated from the second light source part 210 may be maximally condensed to minimize loss of light.

As described above, because the first lamp module 100 and the second lamp module 200 according to the embodiment of the present disclosure are designed such that a light waveguide path is disposed in the optical axis AX and a reflector is deleted, loss of light in the optical system may be minimized. Furthermore, according to the embodiment of the present disclosure, even when a height of the first output surface 190 or the second output surface 290 is decreased for slimness of the lamp, lowering of the optical efficiency may be prevented.

In detail, conventionally, because the lamp 10 for a vehicle has a structure, in which light is reflected through a reflector and is input to a lens, light may be lost in a process of reflecting light from a light source to the reflector, and the light may be lost by the light that fails to be input to the lens according to an incident angle of the reflected light. In the lamp 10 for a vehicle according to the present disclosure, because the light waveguide path is disposed in the optical axis AX and the reflector is deleted as well, optical efficiency may be enhanced by solving the problem.

Meanwhile, referring to FIG. 1, a plurality of first lamp modules 100 and a plurality of second lamp modules 200 may be provided. Here, the numbers of the first lamp modules 100 and the second lamp modules 200 are not limited to the illustrated embodiment, but may be variously modified according to a condition and a design specification required by the applied vehicle.

Furthermore, the plurality of first lamp modules 100 and the plurality of second lamp modules 200 may be alternately disposed along one direction. For example, the first lamp modules 100 and the second lamp modules 200 may be alternately disposed one by one, and as an example, may be arranged in a horizontal direction that is parallel to a ground surface.

However, the arrangement of the first lamp modules 100 and the second lamp modules 200 is not limited to the above-described one, and two or more first lamp modules 100 and adjacent two or more second lamp modules 200 may be alternately disposed, and may be arranged in various directions, such as upward, downward, leftward, and rightward directions.

In this way, the present disclosure may implement various images while satisfying the rules and performances by properly combining the first lamp modules 100 and the second lamp modules 200 to implement the low beam pattern.

The lamp for a vehicle according to the embodiment of the present disclosure may satisfy all of the rules and performances for implementing the low beam pattern by forming the second input surface such that the horizontal shape of the second input surface is concave or flat to diffuse the light input to the second input surface horizontally.

Meanwhile, hereinafter, a lamp for a vehicle according to another aspect of the present disclosure will be described. Hereinafter, for convenience of description, the light source part 110 and the lens structure provided in the lamp 10 for a vehicle according to the another embodiment of the present disclosure are denoted by the same reference numerals as those of the first light source part 110 and the first lens structure 150 provided in the above first lamp module 100.

The lamp 10 for a vehicle according to the present disclosure includes the light source part 110 that irradiates light, and the lens structure 150 that projects the light irradiated from the light source part 110 to form a specific beam pattern.

The lens structure 150 includes the body part 160, the input surface that forms on a surface of the body part 160, to which the light is input, to input the light irradiated from the light source part 110 to the body part 160, and the output surface 190 formed on a surface of the body part 180, to which the light is output to output the light input to the body part 160 to the front side.

In addition, the body part 160 may include the recessed part 170 having a shape that is recessed toward a middle area of the body part 160 in the upward/downward direction, and the recessed part 170 may be configured to shield the light that is output from the light source part 110 and reaches the recessed part 170.

The lamp for a vehicle according to the embodiment of the present disclosure may form the cutoff line without providing a separate shield member by modifying the shape of the lens structure to form the recessed part.

The lamp for a vehicle according to the embodiment of the present disclosure may minimize loss of light generated in the optical system by disposing the light waveguide path in the optical axis, and may prevent lowering of optical efficiency even when the height of the output surface is decreased for slimness of the lamp.

The lamp for a vehicle according to the embodiment of the present disclosure may satisfy all of rules and performances for implementing a low beam pattern by differently forming shapes of the input surfaces of the first lens structure and the second lens structure, to which light is input and diffusing the light input by the second lens structure horizontally.

The lamp for a vehicle according to the embodiment of the present disclosure may form the cutoff line without providing a separate shield member by modifying the shape of the lens structure to form the recessed part.

The lamp for a vehicle according to the embodiment of the present disclosure may minimize loss of light generated in the optical system by disposing the light waveguide path in the optical axis, and may prevent lowering of optical efficiency even when the height of the output surface is decreased for slimness of the lamp.

Although the specific embodiments of the present disclosure have been described until now, the spirit and scope of the present disclosure are not limited to the specific embodiments, and may be variously corrected and modified by an ordinary person in the art, to which the present disclosure pertains, without changing the essence of the present disclosure claimed in the claims.

What is claimed is:

1. A lamp for a vehicle with different lenses, comprising:

a first lamp module including a first light source part and a first lens structure configured to form a first light distribution pattern with light irradiated from the first light source part; and a second lamp module including a second light source part and a second lens structure configured to form a second light distribution pattern with light irradiated from the second light source part, the second light distribution pattern having characteristics that are different from those of the first light distribution pattern, wherein the second lens structure includes, a second body part disposed on a front side of the second light source part;

a second input surface provided on a surface of the second body part, to which the light irradiated from the second light source part is input, such that the light irradiated from the second light source part is input to the second body part; and a second output surface provided on a surface of the second body part, from which the light input to the second body part is output, such that the light input to the second body part d body part, wherein a horizontal shape of the second input surface, viewed from an upper side, is concavely curved in a direction that is opposite to a direction that faces the second light source part, or is flat, and a vertical shape of the second input surface, viewed from a lateral side, is convexly curved in the direction that faces the second light source part;

wherein the first light distribution pattern and the second light distribution pattern overlap each other to form a low beam pattern, and wherein shapes of input surfaces of the first lens structure and the second lens structure are different.

2. The lamp of claim 1, wherein the first lens structure includes:

a first body part disposed on a front side of the first light source part;

a first input surface provided on a surface of the first body part, to which the light irradiated from the first light source part is input, such that the light irradiated from the first light source part is input to the first body part; and a first output surface provided on a surface of the first body part, from which the light input to the first body part is output, such that the light input to the first body part is output to a front side of the first body part, and wherein a horizontal shape of the first input surface, viewed from an upper side, and a vertical shape of the first input surface, viewed from a lateral side, are convexly curved in a direction that faces the first light source part.

3. The lamp of claim 2, wherein the first body part includes a first recessed part having a shape that is curved toward a middle area of the first body part in an upward/downward direction.

4. The lamp of claim 3, wherein the first recessed part shields the light that is output from the first light source part.

5. The lamp of claim 3, wherein the first recessed part includes:

a first shielding layer formed on a surface of the first recessed part and being configured to shield a portion of the light input to the first body part, and a first cutoff edge formed at an upper end of the first recessed part and being configured to form a cutoff line of the low beam pattern.

6. The lamp of claim 5, wherein the first shielding layer extends to be inclined downwards in a direction that faces the first light source part as it goes from the first cutoff edge to a lower side, and is configured to shield the light input to a lower end of the first cutoff edge.

7. The lamp of claim 5, wherein the first recessed part includes:

a first surface provided adjacent the first input surface; and a second surface extending from the first surface and provided adjacent the first output surface, wherein the first shielding layer is formed on the first surface, and wherein the first cutoff edge is formed in an area in which the first surface and the second surface meet each other.

8. The lamp of claim 2, wherein an upward/downward size of the first input surface is larger than or equal to an upward/downward size of the first output surface.

9. The lamp of claim 1, wherein the second body part includes a second recessed part having a shape that is curved toward a middle area of the second body part in an upward/downward direction.

10. The lamp of claim 9, wherein the second recessed part shields the light that is output from the second light source part.

11. The lamp of claim 9, wherein the second recessed part includes:

a second shielding layer formed on a surface of the second recessed part and being configured to shield a portion of the light input to the second body part; and a second cutoff edge formed at an upper end of the second recessed part and being configured to form a cutoff line of the low beam pattern.

12. The lamp of claim 11, wherein the second shielding layer extends to be inclined downwards in a direction that faces the second light source part as it goes from the second cutoff edge to a lower side, and is configured to shield the light input to a lower end of the second cutoff edge.

13. The lamp of claim 12, wherein the second recessed part includes:

a third surface provided adjacent the second input surface; and a fourth surface extending from the third surface and provided adjacent the second output surface, wherein the second shielding layer is formed on the third surface, and wherein the second cutoff edge is formed in an area, in which the third surface and the fourth surface meet each other.

14. The lamp of claim 9, wherein an upward/downward size of the second input surface is larger than or equal to an upward/downward size of the second output surface.

15. The lamp of claim 1, further comprising a plurality of first lamp modules and a plurality of second modules.

16. The lamp of claim 15, wherein the plurality of first lamp modules and the plurality of second lamp modules are alternately disposed along one direction.

17. The lamp of claim 1, wherein the first light source part includes:

a first light source configured to generate light; and a first collimator provided on a front side of the first light source and being configured to convert the light radiated from the first light source to parallel light that is parallel to an optical axis of the first lens structure to input the parallel light to the first lens structure.

18. The lamp of claim 1, wherein the second light source part includes:

a second light source configured to generate light; and a second collimator provided on a front side of the second light source and being configured to convert the light radiated from the second light source to parallel light that is parallel to an optical axis of the second lens structure to input the parallel light to the second lens structure.

* * * * *